US007642717B2

(12) United States Patent
Kim et al.

(10) Patent No.: US 7,642,717 B2
(45) Date of Patent: Jan. 5, 2010

(54) PLASMA DISPLAY PANEL WHICH IS CAPABLE OF MINIMIZING A GAP BETWEEN A SEAL LAYER AND A ULTRA VIOLET RAY/SILICON DESICCANT LAYER AND MANUFACTURING METHOD OF THE SAME

(75) Inventors: Chang Hyun Kim, Daegu (KR); Eung Chul Park, Gumi-si (KR)

(73) Assignee: LG Electronics Inc., Seoul (KR)

( * ) Notice: Subject to any disclaimer, the term of this patent is extended or adjusted under 35 U.S.C. 154(b) by 636 days.

(21) Appl. No.: 11/276,696

(22) Filed: Mar. 10, 2006

(65) Prior Publication Data

US 2007/0069648 A1 Mar. 29, 2007

(30) Foreign Application Priority Data

Sep. 23, 2005 (KR) ..... 10-2005-0089000

(51) Int. Cl.
*H01J 17/49* (2006.01)

(52) U.S. Cl. ..... 313/582

(58) Field of Classification Search ..... 313/498–512, 313/582–587

See application file for complete search history.

(56) References Cited

U.S. PATENT DOCUMENTS

| | | | | |
|---|---|---|---|---|
| 5,754,003 | A | 5/1998 | Murai et al. | |
| 5,886,463 | A * | 3/1999 | Damen et al. | 313/422 |
| 6,261,145 | B1 | 7/2001 | Lee et al. | |
| 6,456,007 | B1 * | 9/2002 | Ryu et al. | 313/586 |
| 2004/0027066 | A1 | 2/2004 | Park et al. | |
| 2005/0051892 | A1 | 3/2005 | Andoh | |
| 2005/0140913 | A1 | 6/2005 | Yokota et al. | |
| 2005/0200268 | A1 * | 9/2005 | Tanaka | 313/498 |

FOREIGN PATENT DOCUMENTS

| | | |
|---|---|---|
| CN | 1381863 | 11/2002 |
| CN | 1506997 | 6/2004 |
| FR | 2 727 568 | 11/1994 |
| JP | 10-170942 | 6/1998 |
| KR | 1020050050528 | 5/2005 |
| KR | 1020060114410 | 11/2006 |

OTHER PUBLICATIONS

European Search Report from Application No. 06005110.9—2008 dated Jun. 6, 2008 (7 pages).
Office Action from Chinese Patent Office for Application No. 200610064844.8 dated Feb. 27, 2009. (12 pages).

* cited by examiner

*Primary Examiner*—Joseph L Williams
(74) *Attorney, Agent, or Firm*—Fish & Richardson P.C.

(57) ABSTRACT

The present invention relates to a plasma display panel, more particularly, to a plasma display panel apparatus and manufacturing method of the same, which is capable of minimizing a gap between a seal layer and a UV Ultra Violet ray / silicon desiccant layer due to an air bubble, when the front panel and the rear panel of the plasma display panel are in the sealing process. A plasma display panel according to the present invention includes a front substrate; a rear substrate; a seal layer which is formed between the front panel and the rear panel; and a desiccant layer which is in contact with the front panel, the rear panel and the seal layer.

15 Claims, 7 Drawing Sheets

(b1)

(b2)

(b3)

(b4)

PLASMA DISPLAY PANEL WHICH IS CAPABLE OF MINIMIZING A GAP BETWEEN A SEAL LAYER AND A ULTRA VIOLET RAY/SILICON DESICCANT LAYER AND MANUFACTURING METHOD OF THE SAME

This application claims the benefit of Korean Patent Application No. 10-2005-0089000, filed on Sep. 23, 2005, which is hereby incorporated by reference for all purposes as if fully set forth herein.

BACKGROUND OF THE INVENTION

1. Field of the Invention

This document relates to a plasma display panel, more particularly, to a plasma display panel apparatus and manufacturing method of the same, which is capable of minimizing a gap between a seal layer and a UV Ultra Violet ray/silicon desiccant layer due to an air bubble, when the front panel and the rear panel of the plasma display panel are in the sealing process.

2. Description of the Background Art

As to the plasma display panel, the ultraviolet ray, which is generated when the inert mixing gas including He+Xe, Ne+Xe and He+Xe+Ne discharges, stimulates a fluorescent substance to display an image. PDP is available for a thin large-size product, in addition, an engineering development makes it possible to improve the picture quality.

FIG. 1 is a schematical diagram of a discharge cell cross section of a conventional plasma display panel.

As to FIG. 1, the plasma display panel is comprised of a scan electrode Y and a sustain electrode Z formed on the front panel not shown and data electrode 3X formed on the rear panel.

The scan electrode Y and sustain electrode Z are formed inparallel on the front panel not shown, including the wide transparent electrode 2Y, 2Z and the narrow bus electrode 1Y, 1Z. The transparent electrode 2Y, 2Z is formed with Indium-Tin-Oxide ITO which is a transparent conduction material, while the bus electrode 1Y,1Z is formed by patterning the silver Ag paste.

An upper-side dielectric layer not shown and a protective film not shown are laminated in order to cover the scan electrode Y and sustain electrode Z in the front panel. Wall charges generated by plasma discharge are stored in the upper-side dielectric layer. The protective film enhances the emission efficiency of the secondary electron with preventing the damage of the upper-side dielectric layer due to a sputtering generated in the plasma discharge. Generally, the magnesium oxide MgO is used as protective film. The data electrode X3 is orthognal with the scan electrode Y and sustain electrode Z.

The lower dielectric layer not shown and a rib 10 are formed in the rear panel. The red R, the blue B and the green G phosphor layer 20R, 20G, 20B are coated in the surface of the dielectric layer and rib 10 on the rear panel. The rib 10 prevents an optical and the electrical crosstalk between the discharge cells which are adjacent by separating discharge space horizontally adjacent. The phosphor layer 20R, 20G, 20B is excited with the ultraviolet ray generated by the plasma discharge to generate one visible ray among the red, the green and the blue.

The inert mixing gas including He+Xe, Ne+Xe and He+Xe+Ne is injected into the discharge space formed between the front panel, the rear panel and the rib 10.

FIG. 2 is a schematical diagram of the plane view of the whole panel shown in FIG. 1.

Referring FIG. 2, the conventional plasma display panel is divided into a panel display part L1 and a panel terminal part L2. Firstly, as described in FIG. 1, the panel display part L1 is formed with the identical structure. That is, the panel display part L1 is comprised of the seal material 201 for suturing the front panel 200 and rear panel 210 to form a discharge cell. The front panel 200 comprises a transparent electrode 2Y, 2Z, a bus electrode 1Y,1Z, a bus electrode pad 206, an upper-side dielectric layer not shown and a protective film not shown. The transparent electrode 2Y, 2Z forms a scan electrode Y and a sustain electrode Z which are formed in parallel on the front panel 200. The bus electrode 1Y, 1Z is formed in the edge of the transparent electrode 2Y, 2Z. The bus electrode pad 206 is extended from the bus electrode 1Y, 1Z to the panel terminal part L2. The upper-side dielectric layer not shown and the protective film not shown are successively laminated on the front panel 200 in order to cover the transparent electrode 2Y, 2Z, the bus electrode 1Y,1Z and the bus electrode pad 206. The data electrode 3X which is formed on the rear panel 210 in order to meet at right angle with the scan electrode Y or the sustain electrode Z. The data electrode 3X is extended to the data electrode pad 207. The data electrode pad 207 is comprised of the film type device such as Tape Carrier Package TCP 205 in which an integrated device is formed on the flexible printed circuit board supplying driving signal. The data electrode pad 207 and the film type device 205 in which the integrated device is formed on flexible printed circuit board is adhered with the anisotropic conductive film ACF not shown. The lower dielectric not shown laminated on the rear panel 210 is provided to cover data electrode 3X.

The panel terminal part L2 on the front panel 200 is comprised of the bus electrode pad 206 extending from the panel display part L1 and the flexible printed circuit board 204 which is connected to the bus electrode pad 206 to supply the driving signal. The bus electrode pad 206 and the flexible printed circuit board 204 are adhered with the anisotropic conductive film ACF not shown. The anisotropic conductive film has a film-type where the conductive particle such as a metal-coated plastic or a metal particle is dispersed, playing a role of electrically connecting the bus electrode 1Y,1Z and flexible printed circuit board 204.

The UV/silicon desiccant layer 203 is coated on the upper side to which the bus electrode 1Y, 1Z and the flexible printed circuit board 204 are connected.

The air bubble 202 or the gap is generated in the process of coating the seal layer 201 and UV/silicon desiccant layer 203 during the sealing of the plasma display panel. In the air bubble 202 region, due to the temperature change of the low temperature and the high temperature, the air expands or condenses. Therefore, the anti-wetting agent is detached or the air bubble is generated so that the exposed part is corroded by the external environment.

Moreover, as the viscosity of the UV/silicon desiccant layer 203 increases, it is unable to sufficiently seep between the interface. Thus, it causes a bad effect in the long-term reliability, because air bubble 202 is generated between the seal layer 201 and the UV/silicon desiccant layer 203.

Moreover, there is a problem in that the electrodes are damaged by the reaction with the external environment, such as temperature, moisture, corrosive gas source or a conductive material, that is, the reaction with the migration in the driving of plasma display panel, because the bus electrode 1Y, 1Z made of silver Ag is exposed to the external air on the panel terminal part L2.

FIG. 3 is a drawing showing the cross section in the line D1-D1', D2-D2', D3-D3', D4-D4' in FIG. 2.

Referring d1 of FIGS. 2 and 3, as to the cross-sectional view which cuts the right side of the plasma display panel in the line D1-D1', the bus electrode pad 206 of the panel terminal part L2 is laminated on the upper side of the front panel 200 in the plasma display panel sealing. The seal layer 201 is formed between the rear panel 210 corresponding with the panel terminal part L2. The bus electrode pad 206 and the flexible printed circuit board 204 formed in the front panel 200 are adhered with the anisotropic conductive film ACF 310.

The UV/silicon desiccant layer 203 is coated onto the upper side to which the bus electrode pad 206 connected to the bus electrode 1Y, 1Z and the flexible printed circuit board 204 are connected.

The air bubble 202 region as much as 11 is generated in the process of coating the seal layer 201 and UV/silicon desiccant layer 203 in sealing the plasma display panel.

As to d2 shown in FIGS. 2 and 3, in the cross-sectional view which cuts the bottom plane of the plasma display panel in the line D2-D2', the data electrode pad 207 of the panel display part L1 is laminated on the upper side of the rear panel 210, the seal layer 201 is formed between the front panel 200 and the rear panel 210 corresponding with the panel display part L1. The data electrode pad 207 formed on the rear panel 210 and the film type device TCP 205 in which the integrated device is formed on the flexible printed circuit board are adhered with the anisotropic conductive film ACF 310. The UV/silicon desiccant layer 203 is coated on the upper side in which data electrode pad 207 connected to the bus electrode 1Y, 1Z and the film type device TCP 205 in which the integrated device is formed on the flexible printed circuit board are connected.

In the process of coating with the seal layer 201 and UV/silicon desiccant layer 203, the air bubble region 202 as much as 12 is formed in the sealing of the plasma display panel.

As to d3 shown in FIGS. 2 and 3, in the cross-sectional view which cuts the left side of the plasma display panel in the line D3-D3', the bus electrode pad 206 of the panel terminal part L2 is laminated on the upper side of the front panel 200, while the seal layer 201 is formed between the front panel 200 and the rear panel 210 corresponding with the panel terminal part L2. The bus electrode pad 206 formed in the front panel 200 is adhered with the anisotropic conductive film 310. The UV/silicon desiccant layer 203 is coated on the upper side in which the bus electrode pad 206 connected to the bus electrode 1Y, 1Z and the flexible printed circuit board 204 are connected.

The air bubble 202 region as much as 13 is generated in the process of coating the seal layer 201 and UV/silicon desiccant layer 203 in the sealing of the plasma display panel.

As to d4 shown in FIGS. 2 and 3, in the cross-sectional view which cuts the right side of the plasma display panel in the line D3-D3', the data electrode pad 207 of the panel display part L1 is not laminated on the upper side of the rear panel 210 in sealing of plasma display panel. Therefore, also, the data electrode pad 207 formed on the rear panel 210, the flexible printed circuit board 204, the anisotropic conductive film ACF 310 and UV/silicon desiccant layer 203 are not coated.

As illustrated in d1 to d3 of FIG. 3, the air bubble 202 region delivers the stress to the UV/silicon desiccant layer 203 due to an expansion and condensation, the panel damage phenomenon is generated due to the anti-wetting agent exfoliation and the transmission of the panel stress, when the temperature changes to the low temperature or to the high temperature.

SUMMARY OF THE INVENTION

Accordingly, an object of the present invention is to solve at least the problems and disadvantages of the rearground art.

The object of the present invention is to provide a plasma display panel capable of preventing an air gap area between the seal layer and the UV/silicon desiccant layer, enhancing the long period reliability when the front panel is sealed with the rear panel in the plasma display panel.

A plasma display panel according to an aspect of the present invention comprises a front substrate; a rear substrate; a seal layer which is formed between the front panel and the rear panel; and a desiccant layer which is in contact with the front panel, the rear panel and the seal layer.

A plasma display panel according to another aspect of the present invention comprises a front substrate including a scan electrode and a sustain electrode; a rear substrate including a data electrode; a seal layer coalesced between the front substrate and rear substrate; and a desiccant layer formed to be in contact with the rear substrate and the seal layer; wherein the seal layer is in contact with the scan electrode and the sustain electrode on the front substrate or the data electrode on the rear substrate.

A method of manufacturing plasma display panel according to still another aspect of the present invention comprises the speps of providing a front panel and a rear panel; providing a seal layer coalesced between the front panel and the rear panel; and providing a desiccant layer which is formed to be in contact with the front panel, the rear panel and the seal layer.

BRIEF DESCRIPTION OF THE DRAWINGS

The accompany drawings, which are included to provide a further understanding of the invention and are incorporated in and constitute a part of this specification, illustrate embodiments of the invention and together with the description serve to explain the principles of the invention. In the drawings.

DETAILED DESCRIPTION OF PREFERRED EMBODIMENTS

Reference will now be made in detail to embodiments of the present invention, examples of which are illustrated in the accompanying drawings.

A plasma display panel according to an aspect of the present invention comprises a front substrate; a rear substrate; a seal layer which is formed between the front panel and the rear panel; and a desiccant layer which is in contact with the front panel, the rear panel and the seal layer.

The outer side surface of the seal layer adheres to the desiccant layer.

The seal layer protrudes substantially more than at least one of the edges of the front panel and the rear panel.

A part of the desiccant layer is formed between the front panel and the rear panel.

The desiccant layer comprises at least one of an ultraviolet ray anti-wetting agent and a silicon anti-wetting agent.

The viscosity of the ultraviolet ray anti-wetting agent equals 2000 cps or less.

The viscosity of the silicon anti-wetting agent equals 10000 cps or less.

A plasma display panel according to another aspect of the present invention comprises a front substrate including a scan electrode and a sustain electrode; a rear substrate including a data electrode; a seal layer coalesced between the front substrate and rear substrate; and a desiccant layer formed to be in contact with the rear substrate and the seal layer; wherein the seal layer is in contact with the scan electrode and the sustain electrode on the front substrate or the data electrode on the rear substrate.

The outer side surface of the seal layer adheres to the desiccant layer.

The desiccant layer comprises at least one of an ultraviolet ray anti-wetting agent and a silicon anti-wetting agent.

A method of manufacturing plasma display panel according to still another aspect of the present invention comprises the steps of providing a front panel and a rear panel; providing a seal layer coalesced between the front panel and the rear panel; and providing a desiccant layer formed to be in contact with the front panel, the rear panel and the seal layer.

The outer side surface of the seal layer adheres to the desiccant layer.

The seal layer protrudes more than at least one of the front panel and the rear panel.

A part of the desiccant layer is formed between the front panel and the rear panel.

The desiccant layer comprises at least one of an ultraviolet ray anti-wetting agent and a silicon anti-wetting agent.

The viscosity of the ultraviolet ray anti-wetting agent equals 2000 cps or less.

The viscosity of the anti-wetting agent equals 10000 cps or less.

An holding time over 5 seconds is maintained after the formation of the desiccant layer.

The front panel includes the scan electrode and the sustain electrode comprising a transparent electrode and a bus electrode.

At least one of the scan electrode and the sustain electrode comprises only the bus electrode.

Hereinafter, exemplary embodiments of the present invention will be described in detail with reference to the attached drawings.

Figure 4:
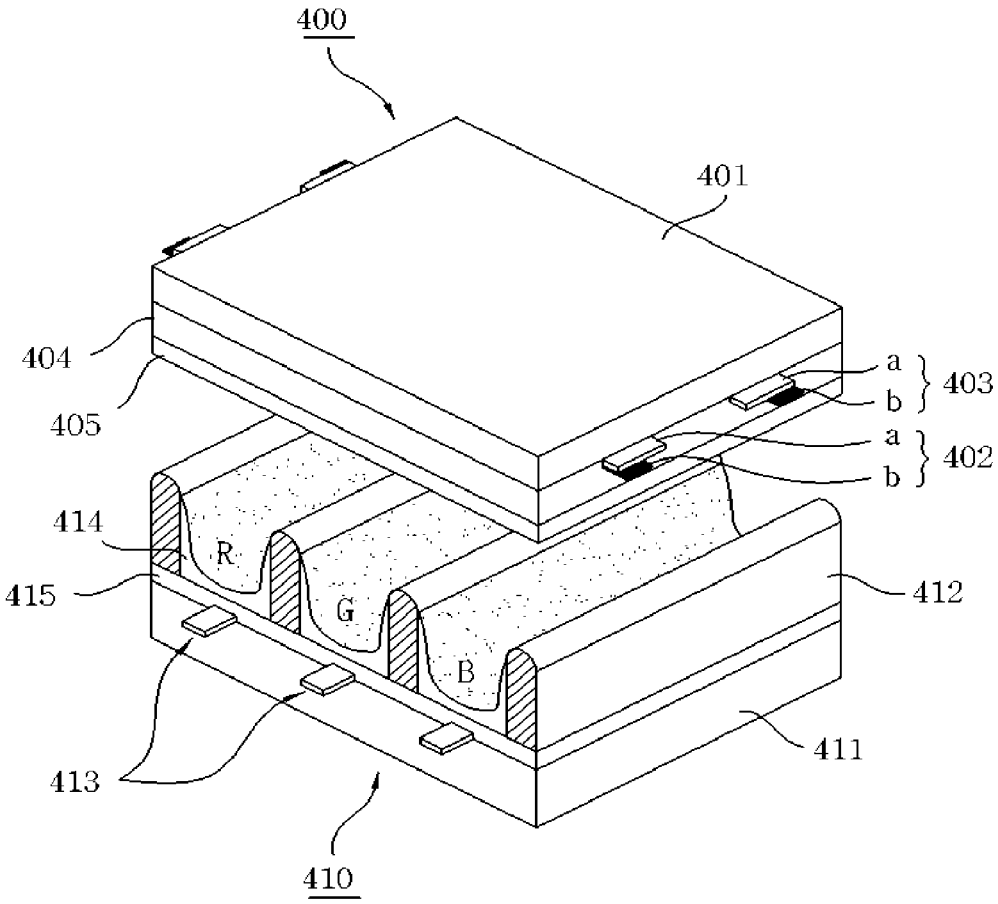
FIG. 4 is a drawing illustrating an example of a structure of a plasma display pane according to the present invention.

FIG. 4 is a drawing illustrating an example of a structure of a plasma display pane according to the present invention.

As to FIG. 4, the plasma display panel is comprised of a front substrate 401 having a front panel 400 for displaying an image and a rear panel 410 having a rear substrate 411, while the front panel 400 is parallelly combined with the rear substrate 411 in a distance. A plurality of sustain electrodes formed with the scan electrode 402, Y and sustain electrode 403, Z which form a pair are disposed on the front substrate 401, while a plurality of data electrodes 413, X are disposed to intersect the plurality of sustain electrodes on the rear substrate 411.

The front panel 400, in one discharge cell, comprises a scan electrode 402 for mutually discharging and maintaining the radiation of the discharge cell and a sustain electrode 403, Z. The scan electrode 402, Y and sustain electrode 403 Z form a pair, including a transparent electrode a made of transparent indium-tin-oxide material ITO and a bus electrode b made of a metal material.

The scan electrode 402, Y and sustain electrode 403, Z are covered with one or more upper side dielectric layer 404 which insulate the electrode pair liver while limiting the discharge current. The protective layer 405 in which the magnesium oxide MgO is deposited is formed in the upper side of the dielectric layer 404 upper side in order to make the discharge condition facilitated.

The rib 412 of a stripe type or a well type for forming a plurality of discharge spaces, that is, for forming a discharge cell arranged in parallel the rear panel 410. Moreover, a plurality of data electrodes X, 413 which perform an address discharge to generate the vacuum ultraviolet ray are arranged in parallel with the rib 412.

R, G, and B fluorescent substance 414 emitting the visible ray for an image display in the address discharge are coated in the upper surface of the rear panel 410. A lower dielectric layer 415 for protecting the data electrode 413, X is formed between the data electrode 413, X and the fluorescent substance 414.

Figure 3:
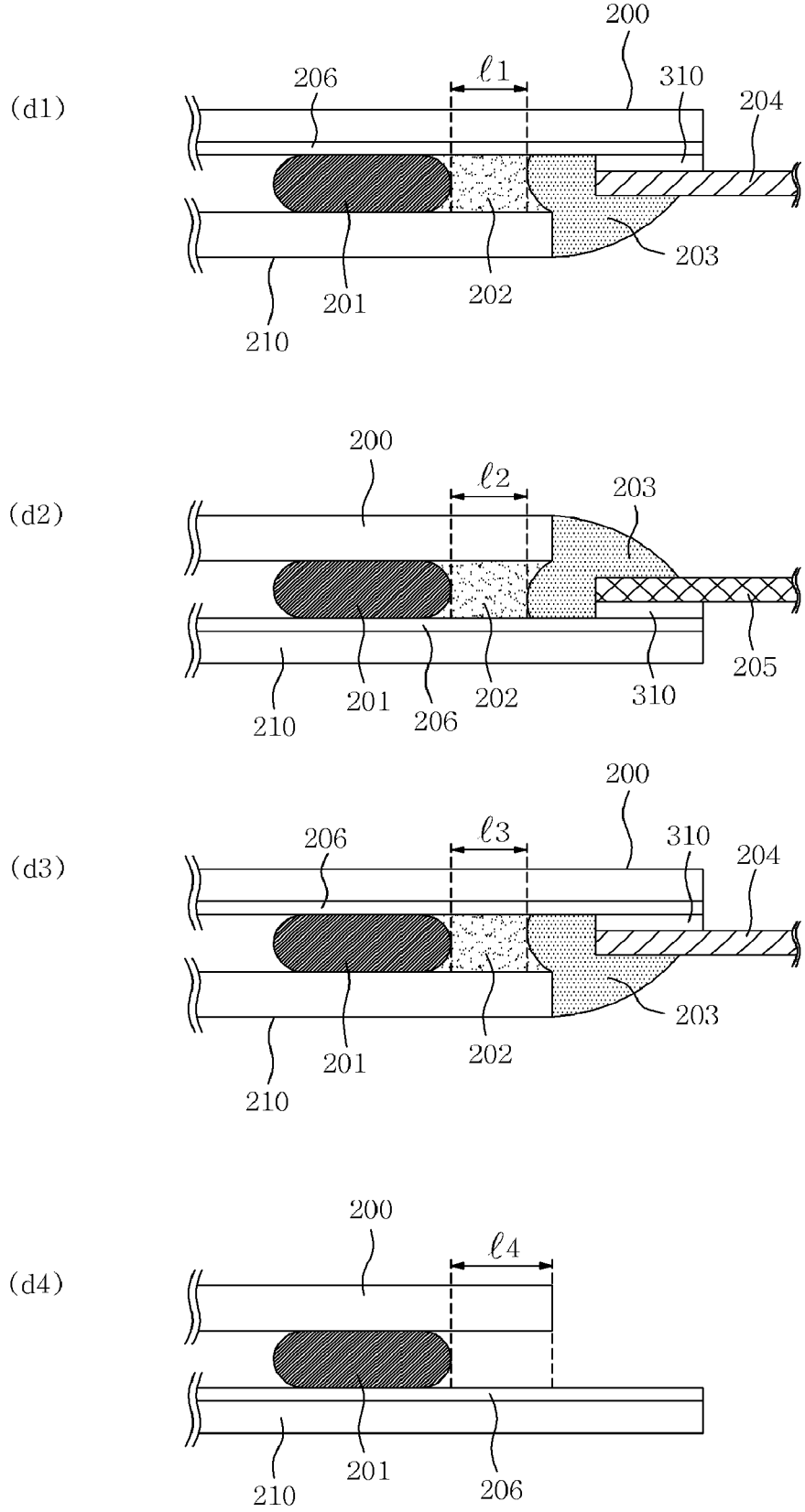
FIG. 3 is a drawing showing the cross section in the line D1-D1', D2-D2', D3-D3', D4-D4' in FIG. 2.

In the FIG. 4, it shows only an example of the structure of plasma display panel which is one of driving element of the plasma display apparatus of the present invention. the present invention is not restricted to the structure of the FIG. 3. For example, in the FIG. 4, it is illustrated that the scan electrode 402, Y and the sustain electrode 403, Z are formed on the front panel 400, while the data electrode 413, X are formed on the rear panel 410. However, the scan electrode 402, Y, the sustain electrode 403, Z and the data electrode 413, X may be altogether formed in the front panel 400.

In other words, it is shown that the scan electrode 402, Y and sustain electrode 403, Z are only consisted of the transparent electrode a and the bus electrode b. However, it is possible that at least one of the scan electrode 104, Y and the sustain electrode 104, Z comprises only the bus electrode b.

Figure 5:
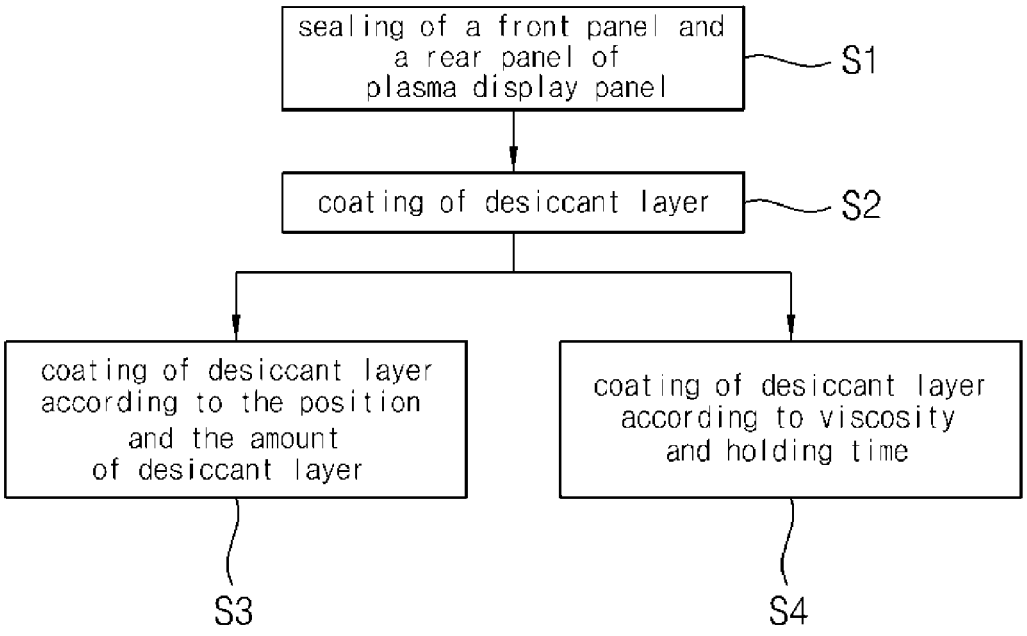
FIG. 5 is a flowchart illustrating the formation method of a desiccant layer in the plasma display panel sealing according to the present invention.
Figure 6:
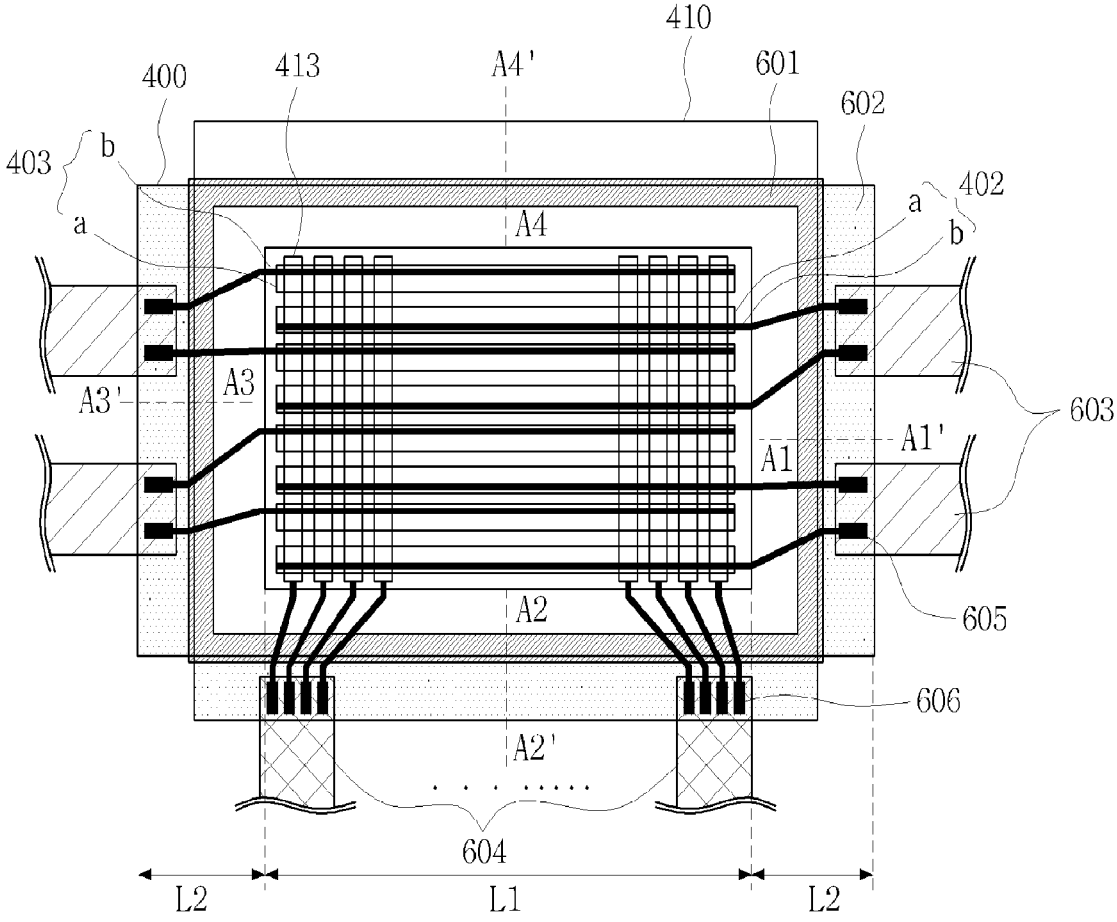
FIG. 6 is a drawing showing a desiccant layer according to an embodiment of the present invention.

FIG. 5 is a flowchart illustrating the formation method of a desiccant layer in the plasma display panel sealing according to the present invention, FIG. 6 is a drawing showing a desiccant layer according to an embodiment of the present invention.

In the present invention, the UV/silicon anti-wetting agent is mainly used as anti-wetting agent. However, the anti-wetting agent for the present invention is not restricted to the above-described UV/silicon anti-wetting agent. Therefore, it is noted that if an anti-wetting agent can perform the same object, then it is applicable in the same way.

As to FIG. 5 and FIG. 6 with FIG. 4, the seal layer 601 is formed between the edge portion of the panel including the scan electrode 402,Y and the sustain electrode 403,Z formed side by side on the front panel 400 and the panel including the data electrode 413 formed to meet the scan electrode 402,Y and the sustain electrode 403,Z at right angle in sealing S1 of the front panel 400 and the rear panel 410.

If the seal layer 601 is formed, the bus electrode pad 605 formed on the front panel 400 of the plasma display panel is adhered to the flexible printed circuit board FPC603 with and the anisotropic conductive film ACF (not shown).

Moreover, the data electrode pad 413 formed on the rear panel 410 and the film type device TCP604 in which the integrated device is formed on the flexible printed circuit board owing to the anisotropic conductive film ACF (not shown) are adhered.

The flexible printed circuit board FPC603 is adhered to the electrode pad on the front panel 400 and the rear panel 410. UV/silicon desiccant layer 602 is coated on the integrated device formed on the flexible printed circuit board, that is, the upper side of the film type device TCP604 S2. At this time, the air bubble gap is generated between the seal layer 601 and UV/silicon desiccant layer 602, which can be prevented by a following method.

To prevent the generation of the air bubble, the UV/silicon desiccant layer 602 coating method S3 about the location of the seal layer 601 is suggested.

After the plasma display panel sealing by improving the processing condition of the seal layer 601, the seal layer coating amount is increased to spread to the edge of the front panel 400 and the rear panel 410 in order that the air bubble area between the UV/silicon desiccant layer 602 is eliminated.

Then, the UV/silicon desiccant layer 602 coating method for the holdingtime and viscosity is suggested S4.

The viscous property is different with the material of the UV/silicon desiccant layer 602.

The UV desiccant layer has a viscosity more than 2000 cps. The silicon desiccant layer has a viscosity more than 10000 cps.

In this case, the viscosity of the UV desiccant layer is used as standard. The manufacturing method described above which improves the preexistence characteristics decreases the viscosity of the desiccant layer below 2000 cps to enhance the spreading rate so that between the region of the air bubble of the seal layer 601 is eliminated.

Moreover, after increasing the coating amount of the UV/silicon desiccant layer 602, the process holdingtime, which is relatively short, from 1 sec to 5 sec is increased over 5 sec so that it is sufficiently seeps on the air bubble region to eliminate the air bubble region of the seal layer 601.

FIG. 6 is a drawing showing the coating of the UV/silicon desiccant layer 602 related with the amount and the location of the seal layer 601 illustrated in FIG. 5 S3.

Figure 1:
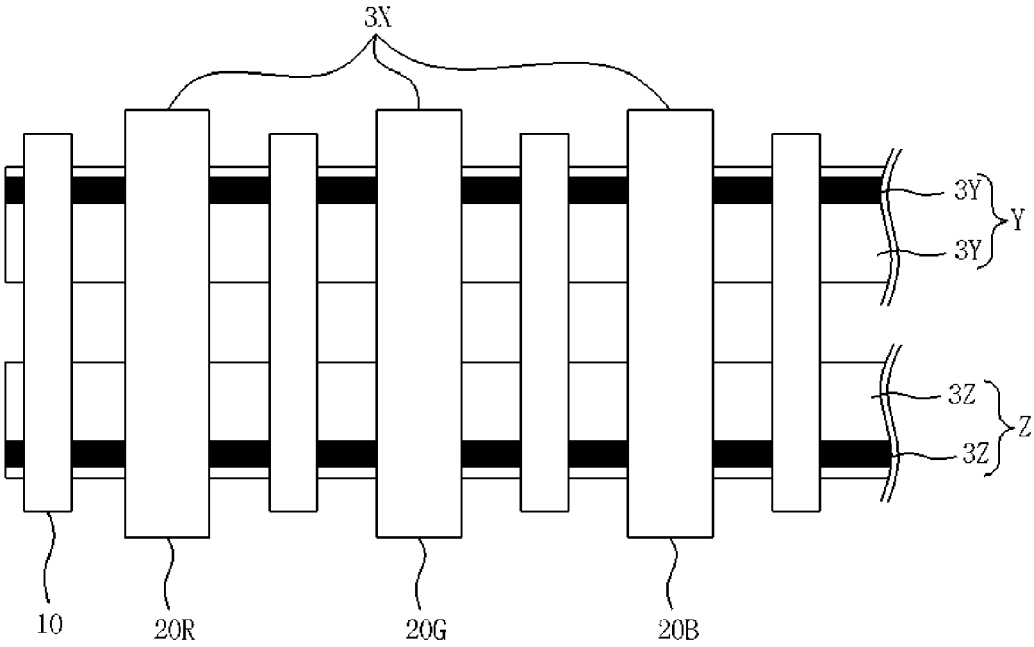
FIG. 1 is a schematical diagram of a discharge cell cross section of a conventional plasma display panel.
Figure 2:
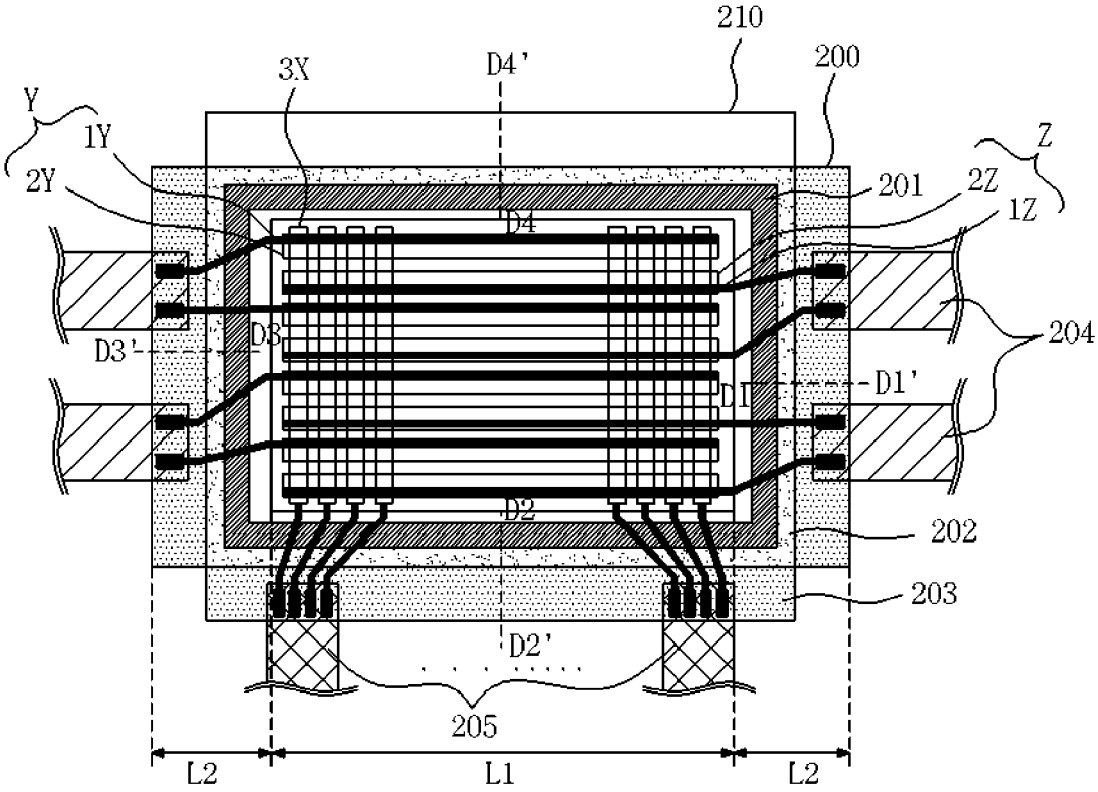
FIG. 2 is a schematical diagram of the plane view of the whole panel shown in FIG. 1.

As shown in FIGS. 6 and 4, the plasma display panel divided into the panel display part L1 and the panel terminal part L2. The panel display part L1 is formed with the same structure in FIG. 1. The panel display part L1 comprises a seal material 601 suturing the front panel 400 and the rear panel 410 to form a discharge cell.

As shown in FIG. 4, the front panel 400 comprises a front substrate 401 including a scan electrode 402,Y and a sustain electrode 403,Z, a transparent electrode a, a bus electrode b, a bus electrode pad 605, the upper dielectric layer 404 and the protective film 405. The scan electrode 402,Y and the sustain electrode 403,Z are formed side by side on the front substrate 401. The scan electrode 402,Y and the sustain electrode 403,Z comprise a transparent electrode a and a bus electrode b formed on an edge of the transparent electrode a. The bus electrode pad 605 is extended from the bus electrode b to the panel terminal part L2. The upper dielectric layer 404 and the protective film 405 are successively laminated on the front panel 400 in order to cover the transparent electrode a, the bus electrode b and bus electrode pad 605.

The rear panel 410 includes a data electrode 413 which is formed to meet with the scan electrode Y or the sustain electrode Z at right angle on the rear substrate 411. The data electrode 413 is formed on the upper side of the rear panel 410 to connect to the data electrode pad 606.

The data electrode pad 606 comprises a film type device, that is, Tape Carrier Package TCP 604 in which the integrated device is formed on the flexible printed circuit board supplying the driving signal. At this time, the data electrode pad 606 and the film type device 604 in which the integrated device is formed on flexible printed circuit board is adhered by the anisotropic conductive film ACF (not shown). The lower dielectric 415 laminated on the rear panel 410 is provided to cover the data electrode 413.

The panel terminal part L2 comprises the bus electrode pad 605 and the flexible printed circuit FPC 603. The bus electrode pad 605 is extended from the panel display part L1 on the front panel 400. The flexible printed circuit FPC 603 is connected to the bus electrode pad 605 for supplying a driving signal. The bus electrode pad 606 is adhered with the flexible printed circuit board 603 by the anisotropic conductive film ACF (not shown).

Here, the anisotropic conductive film ACF is a film-type dispersing the conductive powder such as the metal-coated plastic or the metal particle, playing a role of electrically connecting the flexible printed circuit board 603 to the bus electrode b.

The seal layer 601 is formed to the edge of the front panel 400 and the rear panel 41 in the sealing process of the plasma display panel. After being increased the coating amount appropriately, the UV/silicon desiccant layer 602 is coated.

Therefore, in the process of sealing of the plasma display panel, the air bubble gap region does not exist during the coating of the seal layer 601 and UV/silicon desiccant layer 602. As the air bubble gap region does not exist, though the air expands or condenses due to the temperature change between the low temperature and the high temperature, it does not matter.

Moreover, as the secession of UV/silicon desiccant layer 602 or the air bubble is not generated, the electrode pad 605,606 corrosion can be prevented from the external environment.

In the panel terminal part L2, the bus electrode b consisting of the silver Ag is not exposed to the external air, the electrode damage can be prevented from the reaction with the external environment such as temperature, moisture, a corrosive gas source or a conductive material, that is, the Migration in the plasma display panel driving.

Figure 7:
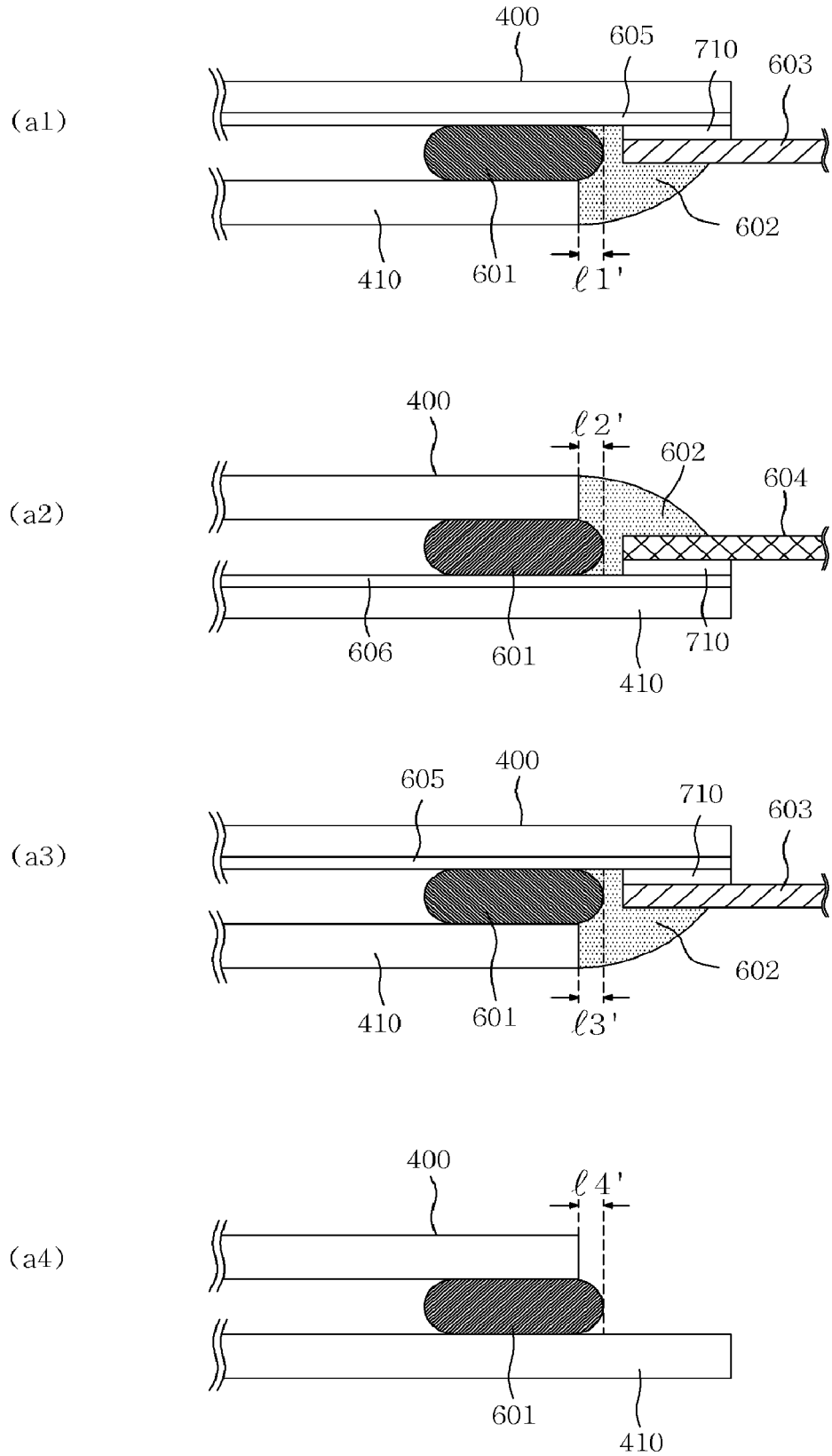
FIG. 7 is a drawing showing the cross section cut in the line A1-A1', A2-A2', A3-A3', A4-A4' in FIG. 6.

FIG. 7 is a drawing showing the cross section cut in the line A1-A1', A2-A2', A3-A3', A4-A4' in FIG. 6.

As to FIG. 6 and the a1 of FIG. 7, the cross-sectional view which cuts the right side of the plasma display panel in the line A1-A1', the bus electrode pad 605 of the panel terminal part L2 is laminated on the upper side of the front panel 400, while the seal layer 601 is formed between the front panel 400 and the rear panel 410 which corresponds to the panel terminal part L2 in the plasma display panel sealing process. The bus electrode pad 605 formed on the front panel 400 is adhered to the flexible printed circuit board FPC603 by the anisotropic conductive film ACF710.

The UV/silicon desiccant layer 602 is coated on the upper side in which the bus electrode pad 605 connected to the bus electrode b is connected to the flexible printed circuit board 204.

The seal layer 601 is protruded in the upper side of the rear panel 410 as much as the interval 11' in the process where the seal layer 601 and UV/silicon desiccant layer 602 are coated in the sealing of the plasma display panel.

Referring to FIG. 6, a2 of FIG. 7, as to the cross-sectional view which cuts the plasma display panel bottom plane in the line A2-A2', the data electrode pad 606 of the panel display part L1 is laminated on the upper side of the rear panel 410, while the seal layer 601 is formed between the front panel 400 and the rear panel 410 which corresponds to the panel display part L1 in the plasma display panel sealing.

The data electrode pad 606 formed on the rear panel 410 are adhered to the film type device TCP604 in which the integrated device is formed on the flexible printed circuit board by the anisotropic conductive film ACF710. The UV/silicon desiccant layer 602 is coated onto the upper side of surface where the data electrode pad 606 connected to the bus electrode b is connected to the film type device TCP604 in which the integrated device is formed on the flexible printed circuit board.

The seal layer 601 is protruded in the upper side of the front panel 400 as much as the interval 12' in the process where the seal layer 601 and UV/silicon desiccant layer 602 are coated in the sealing of the plasma display panel.

Referring to FIG. 6, a3 of FIG. 7, as to the cross-sectional view which cuts the plasma display panel bottom plane in the line A3-A3', the data electrode pad 605 of the panel terminal part L2' is laminated on the upper side of the front panel 400, while the seal layer 601 is formed between the front panel 400 and the rear panel 410 which corresponds to the panel terminal part L2' in the plasma display panel sealing.

The bus electrode pad 605 formed on the front panel 400 is adhered by the anisotropic conductive film ACF710. The UV/silicon desiccant layer 602 is coated onto the upper side of the front panel 400 where the bus electrode pad 605 connected to the bus electrode b is connected to the flexible printed circuit board FPC603.

The seal layer 601 is protruded in the upper side of the rear panel 410 as much as the interval 13' in the process where the seal layer 601 and UV/silicon desiccant layer 602 are coated in the sealing of the plasma display panel.

Referring to FIG. 6, a4 of FIG. 7, as to the cross-sectional view which cuts the plasma display panel bottom plane in the line A4-A4', the data electrode pad 606 of the panel display part L1 is not laminated on the upper side of the rear panel 410. Therefore, data electrode pad 606 formed on the upper side of the rear panel 410, the film type device TCP604 in which the integrated device is formed on the flexible printed circuit board, the anisotropic conductive film ACF710 and UV/silicon desiccant layer 203 are not coated.

As shown in a1 to a3 of FIG. 7, it can be known that the air bubble region illustrated in the d1 to d 3 of FIG. 3 has been disappeared and the location of the seal layer 601 is protruded to the edge part of the front panel 400 and the rear panel 410 in the sealing of the plasma display panel. That is, the air bubble is not originated in the seal layer 601 when the UV/silicon desiccant layer 602 is coated.

Therefore, in the manufacturing process of the plasma display panel in the temperature change between the low temperature and the high temperature, the stress is delivered to the UV/silicon desiccant layer 602 due to an expansion and condensation of the air gap area so that the panel damage due to the anti-wetting agent exfoliation and the panel stress transmission can be prevented.

Figure 8:
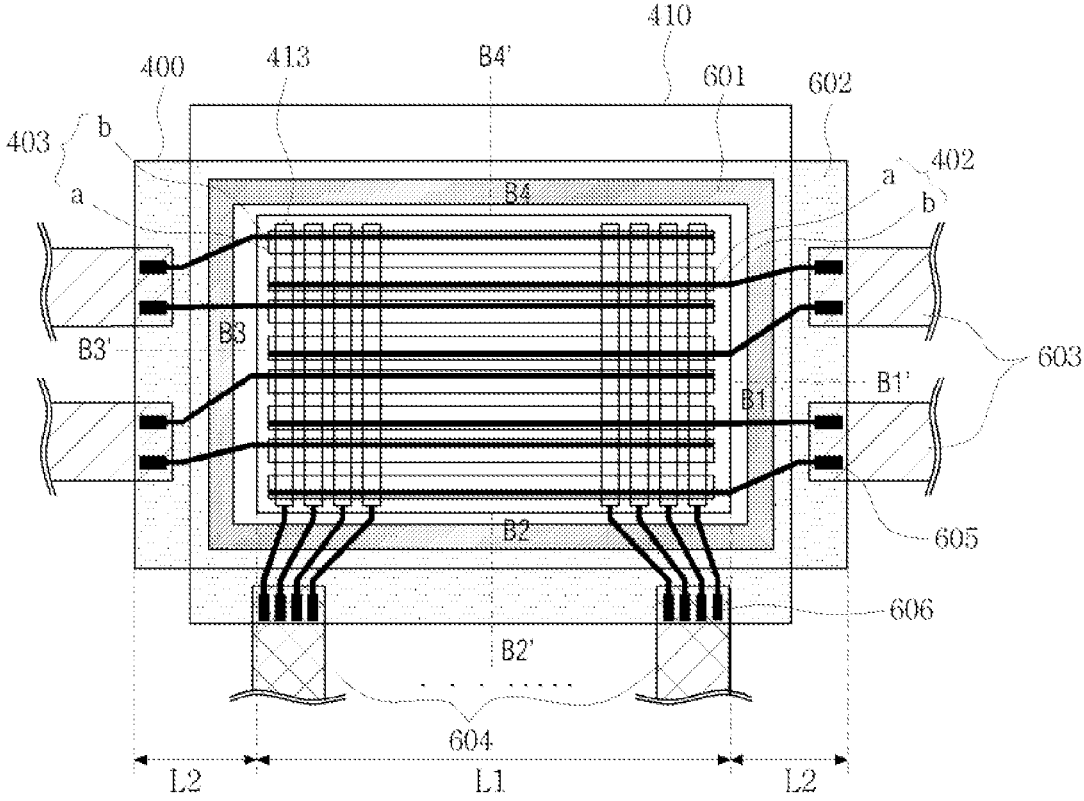
FIG. 8 is a drawing showing a desiccant layer according to another embodiment of the present invention.

FIG. 8 is a drawing showing a desiccant layer according to another embodiment of the present invention.

As to FIG. 8, as shown in FIG. 4, the plasma display panel according to the present invention comprises a panel display part L1 and a panel terminal part L2. The panel display part L1 is formed with the identical structure described in FIG. 1. That is, the panel display part L1 is comprised of the seal material 601 suturing the front panel 400 and the rear panel 410 to form a discharge cell.

As in FIG. 4, a front panel 400 comprises a transparent electrode a and a bus electrode b which form a scan electrode 402,Y or a sustain electrode 403, Z disposed on a front substrate 401 side by side, a bus electrode pad 605, an upper-side dielectric layer 404 and a protective film 405. The bus electrode pad 605 is extended from the bus electrode b to the panel terminal part L2. The upper-side dielectric layer 404 and the protective film 405 is successively laminated on the front panel 400 in order to cover the transparent electrode a, the bus electrode b and the bus electrode pad 605.

The rear panel 410 includes the data electrode 413 which is formed on the rear substrate 411, meeting the scan electrode Y and the sustain electrode Z at right angle. The data electrode 413 is formed in the upper side of the rear panel 410, being connected to the data electrode pad 606.

The extended data electrode pad 606 comprises the film type device Tape Carrier Package TCP 604 in which the integrated device is formed on the flexible printed circuit board supplying a driving signal. As shown in FIG. 7, the data electrode pad 606 is adhered to the film type device 604 in which the integrated device is formed on the flexible printed circuit board by the anisotropic conductive film ACF 710. The upper dielectric 415 laminated on the rear panel 410 is provided to cover the data electrode 413.

The panel terminal part L2 comprises a bus electrode pad 605, formed on the front panel 400, extended from the panel display part L1 and a flexible printed circuit FPC 603 which is connected to the bus electrode pad 605 and supplies the driving signal.

The bus electrode pad 606 is adhered to the flexible printed circuit board 603 by the anisotropic conductive film ACF 710. Here, the anisotropic conductive film ACF 710 is a film-type where the conductive powder including the metal-coated plastic or the metal article is disperse, playing a role of electrically connecting the bus electrode b to the flexible printed circuit board 603.

The seal layer 601 is formed between the front panel 400 and the rear panel 410, while the UV/silicon desiccant layer 602 is coated onto the outer side of the seal layer 601 in the sealing of the plasma display panel.

When the UV/silicon desiccant layer 602 is coated onto the outer side of the seal layer 601 by lowering the viscosity, the air gap area is disappeared because of sufficient seeping of the UV/silicon desiccant between the seal layer 601.

According to material of the UV/silicon desiccant layer 602, the viscosity characteristics should be controlled like a below.

That is, the viscosity of the UV desiccant layer should be lowered below 2000 cps, while the viscosity of the silicon desiccant layer should be lowered below 10000 cps before coating for flexible coating onto the outer side of the seal layer 601.

Moreover, in the sealing of the plasma display panel, after the coating amount of the UV/silicon desiccant layer 602 is befittingly increased, the holdingtime which is a process waiting time ranged from 1 sec to 5 sec is set to be over 5 sec so that the time in which the UV/silicon desiccant layer 602 is sufficiently soaked to the outer side of the seal layer 601 can be secured for safe coating.

When the UV/silicon desiccant layer 602 is safely coated on the seal layer 601, it is possible to prevent the corrosion of the electrode pad 605, 606 from the external environment and the damage of an electrode from the temperature of the external environment, the moisture, and the reaction with the corrosive gas source or the conductivity material, that is, a migration.

Figure 9:
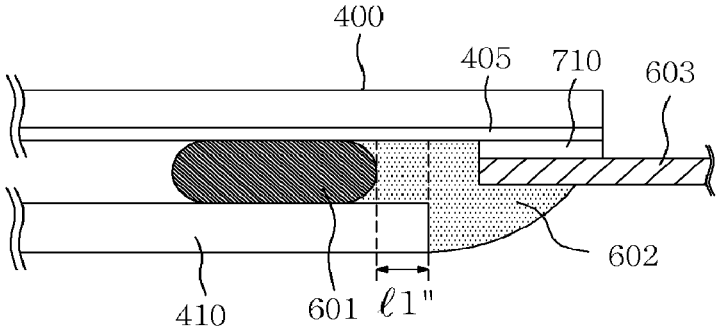
FIG. 9 is a drawing showing the cross section cut in the line B1-B1', B2-B2', B3-B3', B4-B4' in FIG. 8.
Figure 9:
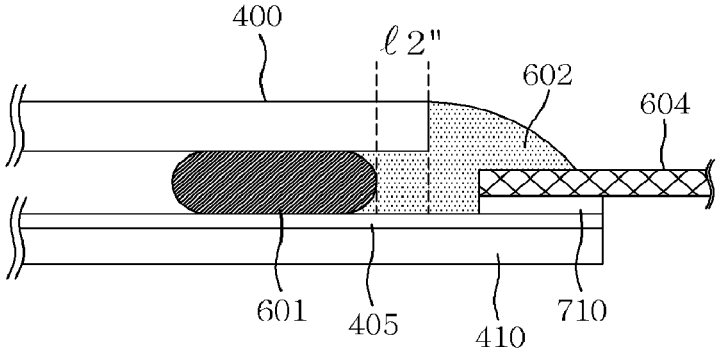
Figure 9:
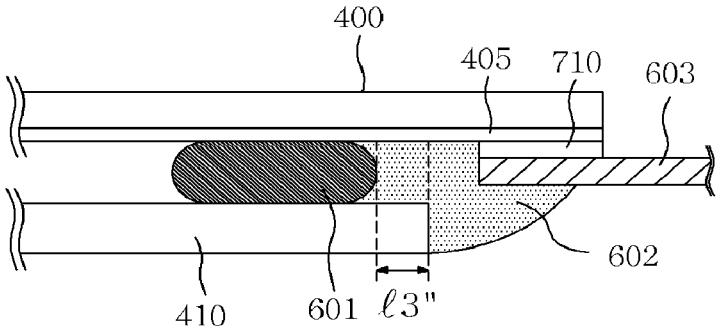
Figure 9:
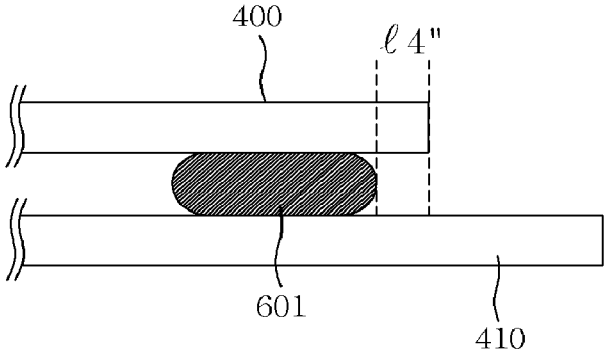

FIG. 9 is a drawing showing the cross section cut in the line B1-B1', B2-B2', B3-B3', B4-B4' in FIG. 8.

As to FIG. 8 and the b1 of FIG. 9, the cross-sectional view which cuts the right side of the plasma display panel in the line B1-B1', the bus electrode pad 605 of the panel terminal part L2 is laminated on the upper side of the front panel 400, while the seal layer 601 is formed between the front panel 400 and the rear panel 410 which corresponds to the panel terminal part L2 in the plasma display panel sealing process. The bus electrode pad 605 formed on the front panel 400 is adhered to the flexible printed circuit board FPC603 by the anisotropic conductive film ACF710.

The UV/silicon desiccant layer 602 is coated on the upper side of the surface in which the bus electrode pad 605 connected to the bus electrode b is connected to the flexible printed circuit board 204.

The UV/silicon desiccant layer 602 are coated into the seal layer 601 formed on the upper side of the rear panel 410 as much as the interval 11' by lowering the viscosity of the UV/silicon desiccant layer 602 in the process where the seal layer 601 and UV/silicon desiccant layer 602 are coated in the sealing of the plasma display panel.

Referring to FIG. 8, b2 of FIG. 9 as to the cross-sectional view which cuts the plasma display panel bottom plane in the line B2-B2', the data electrode pad 606 of the panel display part L1 is laminated on the upper side of the rear panel 410, while the seal layer 601 is formed between the front panel 400 and the rear panel 410 which corresponds to the panel display part L1 in the plasma display panel sealing.

The data electrode pad 606 formed on the rear panel 410 are adhered to the film type device TCP604 in which the integrated device is formed on the flexible printed circuit board by the anisotropic conductive film ACF710. The UV/silicon desiccant layer 602 is coated onto the upper side of surface where the data electrode pad 606 connected to the bus electrode b is connected to the film type device TCP604 in which the integrated device is formed on the flexible printed circuit board.

The UV/silicon desiccant layer 602 are coated into the seal layer 601 formed on the upper side of the front panel 400 as much as the interval 12' by lowering the viscosity of the UV/silicon desiccant layer 602 in the process where the seal layer 601 and UV/silicon desiccant layer 602 are coated in the sealing of the plasma display panel.

Referring to FIG. 8, a3 of FIG. 9, as to the cross-sectional view which cuts the plasma display panel bottom plane in the line B3-B3', the bus electrode pad 605 of the panel terminal part L2 is laminated on the upper side of the front panel 400, while the seal layer 601 is formed between the front panel 400 and the rear panel 410 which corresponds to the panel terminal part L2 in the plasma display panel sealing.

The bus electrode pad 605 formed on the front panel 400 is adhered by the anisotropic conductive film ACF710. The UV/silicon desiccant layer 602 is coated onto the upper side of the front panel 400 where the bus electrode pad 605 connected to the bus electrode b is connected to the flexible printed circuit board FPC603.

The UV/silicon desiccant layer 602 are coated into the seal layer 601 formed on the upper side of the rear panel 410 as much as the interval 13' by lowering the viscosity of the UV/silicon desiccant layer 602 in the process where the seal layer 601 and UV/silicon desiccant layer 602 are coated in the sealing of the plasma display panel.

Referring to FIG. 8, b4 of FIG. 9, as to the cross-sectional view which cuts the plasma display panel upper plane in the line B4-B4', the data electrode pad 606 of the panel display part L1 is not laminated on the upper side of the rear panel 410. Therefore, data electrode pad 606 formed on the upper side of the rear panel 410, the film type device TCP604 in which the integrated device is formed on the flexible printed circuit board, the anisotropic conductive film ACF710 and UV/silicon desiccant layer 203 are also not coated.

Therefore, the seal layer 601 is caved into the inside as much as 14" from the front panel 400 in the plasma display panel sealing.

As shown in the b1 to b3 of FIG. 9, the air gap region 202 illustrated in d1 to d3 of FIG. 3 is disappeared. Further, the UV/silicon desiccant layer 602 are coated into the seal layer 601 formed on the upper side of the front panel 400 and the upper side of the rear panel 410 as much as the interval 11", 12", 13' by lowering the viscosity of the UV/silicon desiccant layer 602 in the sealing of the plasma display panel. Therefore, the air bubble is not generated between the seal layer 601.

When the temperature changes between a low temperature and a high temperature in the manufacturing process of the plasma display panel, the stress is delivered to the UV/silicon desiccant layer 602 due to the expansion and the condensation of the air bubble region. Accordingly, the panel damage due to an anti-wetting agent exfoliation and a panel stress transmission can be prevented.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel comprising:

a front substrate;

a rear substrate:

a seal layer formed between the front substrate and the rear substrate to seal the front substrate and the rear substrate; and a desiccant layer in contact with the front substrate, the rear substrate and the seal layer, wherein the desiccant layer is an ultraviolet ray desiccant layer.

2. The plasma display panel of claim 1, wherein the outer side surface of the seal layer adheres to the desiccant layer.

3. The plasma display panel of claim 1, wherein the seal layer protrudes substantially more than at least one of the edges of the front substrate and the rear substrate.

4. The plasma display panel of claim 1, wherein a part of the desiccant layer is formed between the front substrate and the rear substrate.

5. The plasma display panel of claim 1, wherein the viscosity of the ultraviolet ray desiccant layer equals 2000 cps or less.

6. A plasma display panel comprising:

a front substrate comprising a scan electrode and a sustain electrode;

a rear substrate comprising a data electrode;

a seal layer attached between the front substrate and the rear substrate; and a desiccant layer formed to be in contact with the rear substrate and the seal layer;

wherein the seal layer is in contact with the scan electrode and the sustain electrode on the front substrate or the data electrode on the rear substrate, and wherein the desiccant layer is an ultraviolet ray desiccant layer.

7. The plasma display panel of claim 6, wherein the outer side surface of the seal layer adheres to the desiccant layer.

8. A method of manufacturing a plasma display panel, the method comprising:

providing a front substrate and a rear substrate;

providing a seal layer attached between the front substrate and the rear substrate; and providing a desiccant layer formed to be in contact with the front substrate, the rear substrate and the seal layer, wherein the desiccant layer is an ultraviolet ray desiccant layer.

9. The method of claim 8, wherein the outer side surface of the seal layer adheres to the desiccant layer.

10. The method of claim 8, wherein the seal layer protrudes substantially more than at least one of the front substrate and the rear substrate.

11. The method of claim 8, wherein a part of the desiccant layer is formed between the front substrate and the rear substrate.

12. The method of claim 8, wherein the viscosity of the ultraviolet ray desiccant layer equals 2000 cps or less.

13. The method of claim 11, maintaining a holding time over 5 seconds after the formation of the desiccant layer.

14. The method of claim 11, wherein the front substrate comprises a scan electrode and a sustain electrode comprised of at least a transparent electrode or a bus electrode.

15. The method of claim 14, wherein at least one of the scan electrode and the sustain electrode comprises only the bus electrode.

* * * * *